United States Patent [19]

Nichols

[11] Patent Number: 4,699,430

[45] Date of Patent: Oct. 13, 1987

[54] MATERIAL STRIPPING APPARATUS

[76] Inventor: Rex Nichols, 3025 Southfork Ct., Wichita, Kans. 67216

[21] Appl. No.: 858,008

[22] Filed: May 1, 1986

[51] Int. Cl.[4] ..... A47L 11/12; E04D 15/00

[52] U.S. Cl. ..... 299/37; 15/93 R; 30/170

[58] Field of Search ..... 299/37; 15/93 R; 30/169, 170

[56] References Cited

U.S. PATENT DOCUMENTS

| | | | |
|---|---|---|---|
| 2,519,138 | 8/1950 | Katz | 299/37 |
| 2,777,680 | 1/1957 | Robb | 299/37 |
| 2,906,514 | 9/1959 | Becker | 15/93 R |
| 3,376,071 | 4/1968 | Stein | 299/37 |
| 4,009,908 | 3/1977 | Alinder et al. | 30/169 X |
| 4,053,958 | 10/1977 | Taylor | 299/37 X |
| 4,091,535 | 5/1978 | Lehrter | 299/37 X |
| 4,162,809 | 7/1979 | Anderson et al. | 299/37 |
| 4,277,104 | 7/1981 | Sanchez | 30/169 X |
| 4,504,093 | 3/1985 | Grasse | 299/37 |

*Primary Examiner*—Stephen J. Novosad
*Assistant Examiner*—David J. Bagnell
*Attorney, Agent, or Firm*—Phillip A. Rein

[57] ABSTRACT

This invention is a material stripping apparatus resembling a conventional lawn mower structure having means thereon for controlling the energization and lateral speed of the entire apparatus. The material stripping apparatus further includes a forwardly projecting lift plate member which is operable to be placed beneath roofing shingle members in order to remove same from the supporting roof structure. The material stripping apparatus includes a lift actuator means to move the lift plate member in a forwardly, upwardly, and oscillating manner so as to remove the shingle members and their anchor nails from the support surface with a minimum amount of time and effort on the part of the operator using the subject invention.

6 Claims, 9 Drawing Figures

FIG. 1
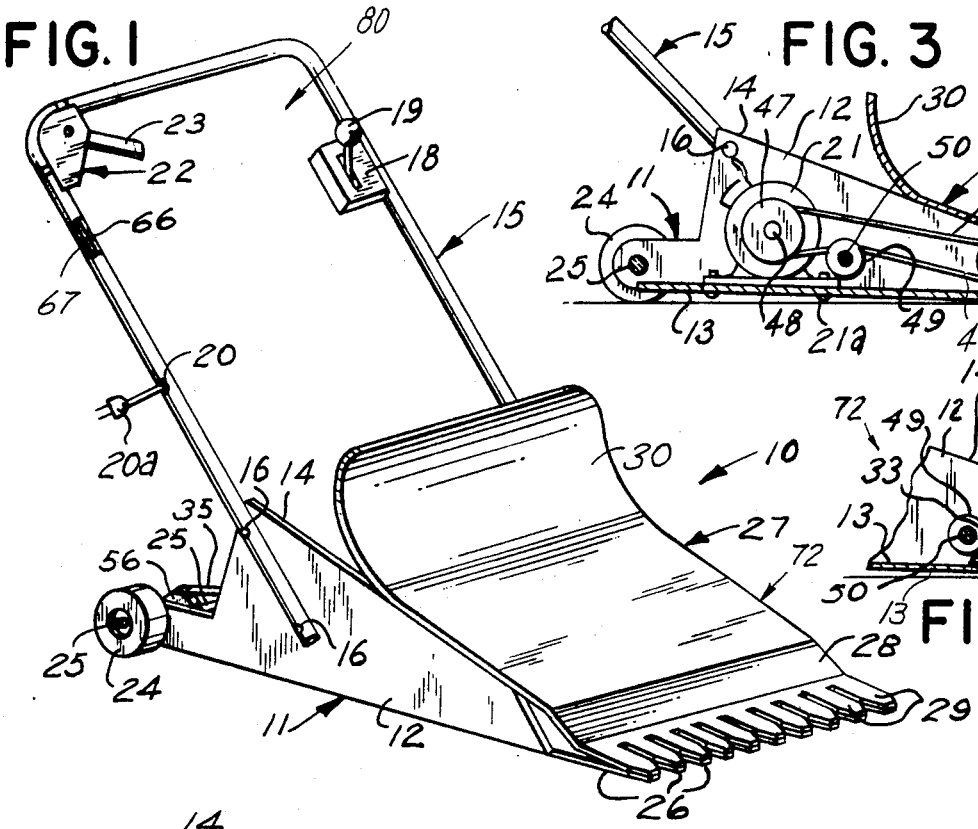
FIG. 3
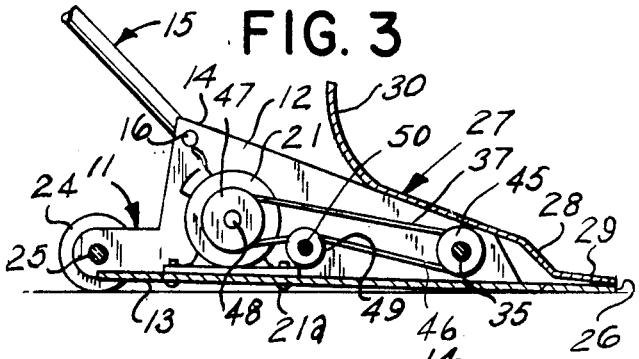
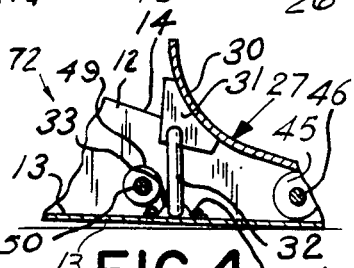
FIG. 4
FIG. 2
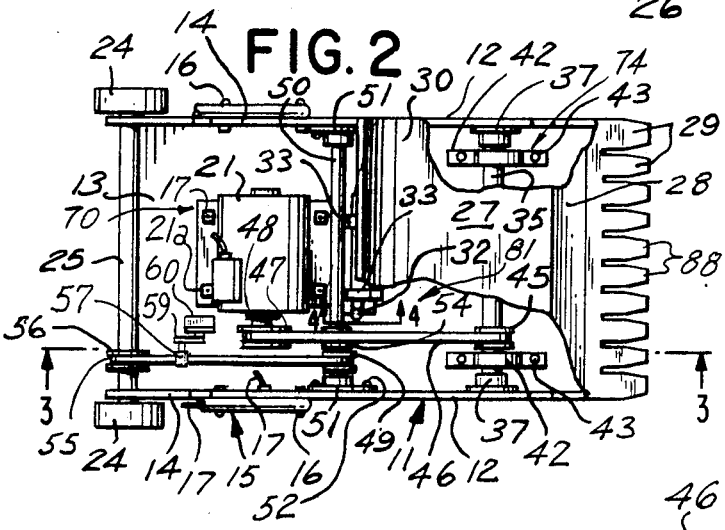
FIG. 5
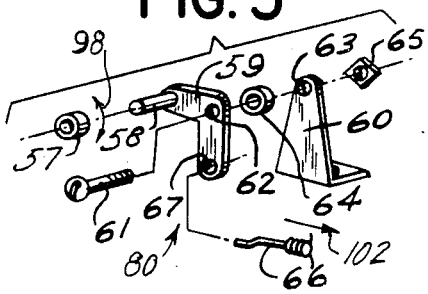
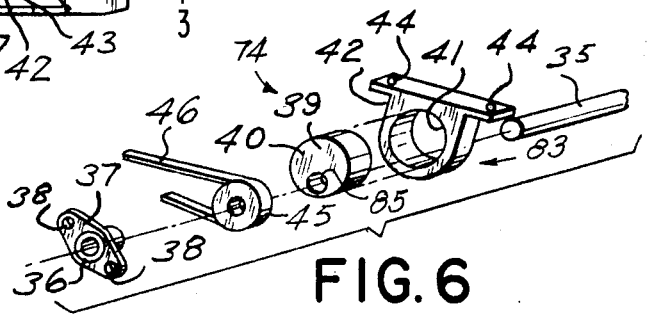
FIG. 6
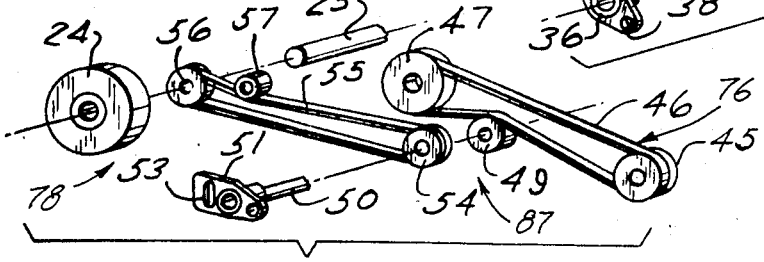
FIG. 7

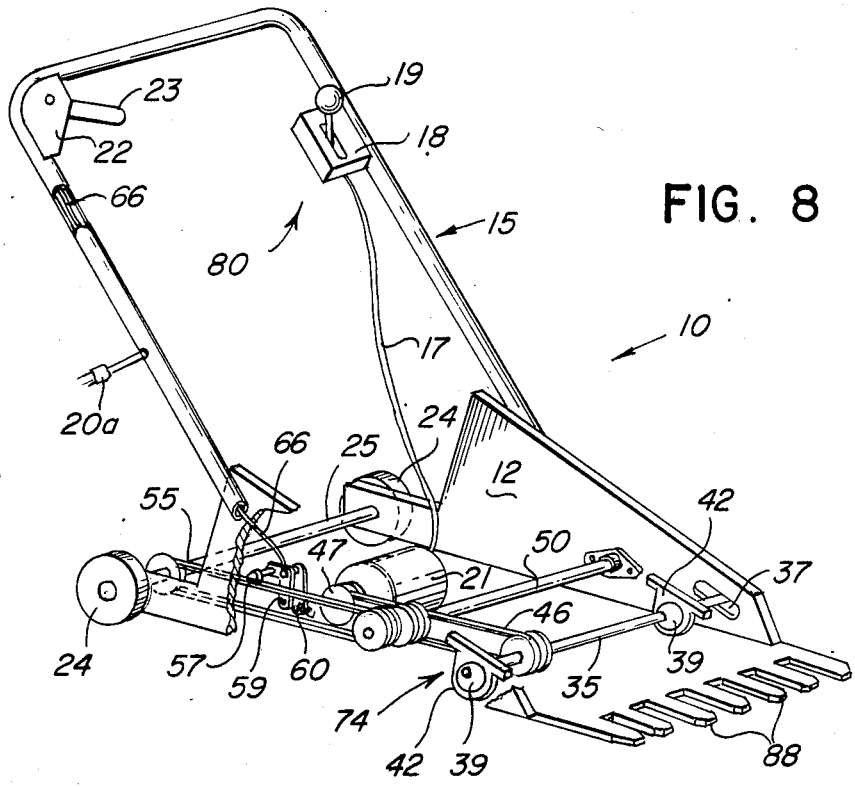
FIG. 8
FIG. 9
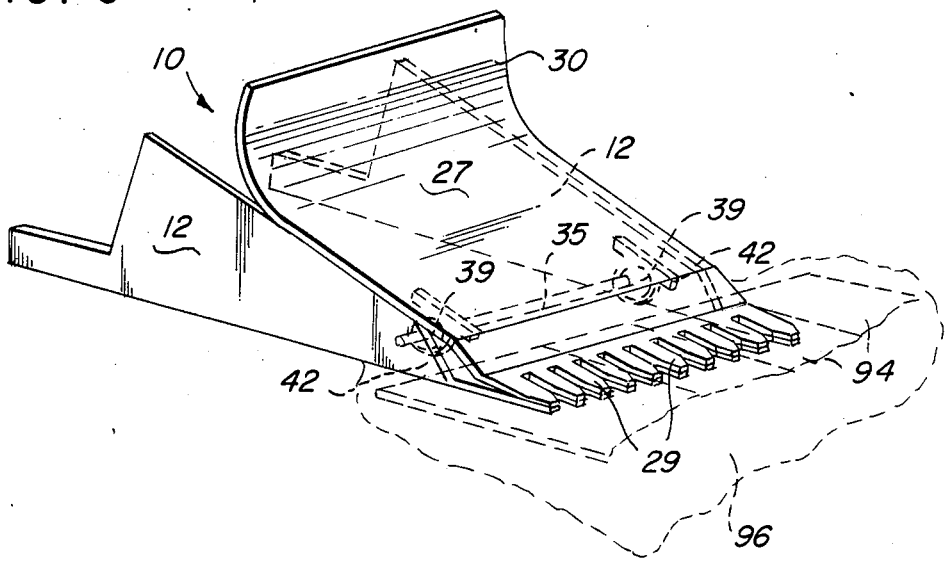

MATERIAL STRIPPING APPARATUS

PRIOR ART

A patentability investigation was conducted on this invention and the following United States patents are noted:

| Reg. No. | Name | Inventor |
|---|---|---|
| 3,251,629 | MATERIAL STRIPPING MACHINE | Crawley |
| 3,542,433 | APPARATUS FOR REMOVING ROOFING | Probst |
| 3,726,565 | MATERIAL STRIPPING APPARATUS AND BLADE | Oliverius |
| 4,091,535 | SHINGLE STRIPPER | Lehrter |
| 4,277,104 | RECIPROCATING SHINGLE REMOVER WITH UPWARD THRUST BLADE | Sanchez |
| 4,444,434 | CONTINUOUS MINER | Gurries |

It is noted that numerous patents disclose portable, reciprocating roof shingle removing structures which appear generally similar to the applicant's invention herein. For example, the Sanchez, Hehrter, and Probst patents disclose gasoline operated structures utilizing reciprocating blade members to be placed underneath the roofing shingles to be removed utilizing an agitating and generally reciprocating type movement.

The Gurries patent discloses a rather elaborate structure utilized for continuous mining process which is rather bulky and complex compared to the applicant's invention set forth herein.

The Crawley and Oliverius patents disclose electrically operated material stripping apparatuses with blades thereon to remove shingles utilizing a reciprocating movement.

Although the basic function of the applicant's invention is shown by the patents noted herein, it is submitted that the applicant's new and novel reciprocating and oscillating movement is patentable thereover.

PREFERRED EMBODIMENT OF THE INVENTION

One preferred embodiment of this invention is a material stripping apparatus including (1) a main support frame means or assembly; (2) a power means or assembly mounted on the main support frame assembly; (3) a material lift means or assembly mounted on the main support frame assembly; (4) a lift actuator means assembly operably connected to the material lift means to actuate same; (5) an actuator drive means or assembly operably connected to the lift actuator means; (6) an apparatus drive means or assembly connected to the main frame means in order to propel the entire apparatus; and (7) an apparatus control means or assembly operably connected to the apparatus drive means and the lift actuator means so as to selectively operate same. The main frame means and the power means substantially resemble an electric lawn mower type structure having a main frame mounted on wheel members and a handle assembly for steering purposes, all driven by the apparatus drive means. The main novelty in this invention relates to the material lift means and the lift actuator means connected thereto which is operable to place a lift plate underneath shingles, linoleum, or other materials which are desired to be removed from a support surface. The lift means includes a lift plate member which is moveable in a reciprocating and oscillating manner to be moved underneath the shingles or other like materials to vertically and, subsequently, laterally move such material to separate from the support surface. The apparatus control means is operable to selectively control (1) forward motion of the entire material stripping apparatus; and (2) movement of the lift plate member in the reciprocating-oscillating manner.

OBJECTS OF THE INVENTION

One object of this invention is to provide a material stripping apparatus which is operable to remove material from a support surface such as shingles from a roof structure having a unique means of removing subject material with a minimum amount of time and effort by the operator thereof.

Another object of this invention is to provide a material stripping apparatus of a portable nature which can be powered by an electric motor or gasoline engine and utilizes a cam operated, forwardly projecting lift plate member for engaging with and removing, for example, shingles from a roof structure.

One further object of this invention is to provide a material stripping apparatus operable to remove shingles from a roof and having a deflector plate or means thereon for directing the loosened shingles in an upward and lateral movement so that the apparatus can be operated in a continuous manner during its shingle removing operation.

Still, one further object of this invention is to provide a material stripping apparatus which is portable and, thus, easily conveyed and used on roof tops to remove shingles therefrom and having numerous features so as to be safe in operation.

One other object of this invention is to provide a material stripping apparatus which resembles a conventional lawn mower type structure having a new and novel lift means thereon with a lift plate member which is movable in a combination reciprocating and oscillating movement so as to have a forward blade portion to be placed under to engage, detach, and lift shingle members on a roof in an efficient and effective manner.

An additional object of this invention is to provide a material stripping apparatus which is lightweight and portable in usage; economical to manufacture; safe in operation; and substantially maintenance free.

Various other objects, advantages, and features of this invention will become apparent to those skilled in the art from the following description, taken in conjunction with the accompanying drawings in which:

FIG. 1 is a perspective view of a material stripping apparatus of this invention;

FIG. 2 is a fragmentary top plan view of the material stripping apparatus of this invention having portions thereof removed for clarity;

FIG. 3 is a fragmentary sectional view taken along lines 3—3 in FIG. 2;

FIG. 4 is a fragmentary sectional view taken along lines 4—4 in FIG. 2;

FIG. 5 is an exploded perspective view of a drive wheel idler assembly of the material stripping apparatus of this invention;

FIG. 6 is an exploded perspective view of a lift actuator means of the material stripping apparatus of this invention;

FIG. 7 is an exploded perspective view of the apparatus drive means of the material stripping apparatus of this invention;

FIG. 8 is a perspective view similar to FIG. 1 with portions broken away for clarity; and FIG. 9 is a fragmentary schematic diagram illustrating operation of a lift plate member of the material stripping apparatus of this invention.

The following is a discussion and description of preferred specific embodiments of the new material stripping apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a material stripping apparatus of this invention, indicated generally at 10, includes (1) a main support frame means or assembly 11; (2) a power means 70 mounted on the main support frame means 11; (3) a material lift means 72 mounted on the main support frame means 11; (4) a lift actuator means 74 operably connected to the material lift means 72; (5) an actuator drive means 76 connected to the lift actuator lift means 74 to actuate same; (6) an apparatus drive means 78 mounted on the main support frame means 11 and operable to move same; and (7) an apparatus control means 80 operable to provide means for energization of the actuator drive means 76 and the lift actuator means 74 as will be explained.

The main support frame assembly 11 includes a pair of spaced, parallel sidewall members 12 interconnected at a lower surface thereof to a bottom wall 13. The bottom wall 13 has a plurality of adjacent, spaced teeth members 88 at a forward portion to cooperate with the material lift means 72. The sidewall members 12 are each provided with upper peripheral and aligned top edges 14 which are inclined in a downwardly, forward manner to receive a portion of the material lift means 72 thereon.

The main frame assembly 11 further includes a U-shaped handle bar member 15 that resembles a lawn mower handle and which is connected at a lower end portion thereof by fasteners 16 to respective ones of the opposed, parallel, sidewall members 12.

The powwer means 70 include a drive motor member 21; an electrical power cord member 17 connected to electric drive motor member 21 through an on-off, speed control assembly 18 in order to actuate same. The power cord 17 is shown with a plug member 20*a* which is operable to be plugged into an electric extension cord normally energized with 110 volt A.C. current similar to an electric lawn mower.

The power cord 17 extends through the U-shaped handle member 15 and is wired to the on/off control assembly 18 which has control knob or lever 19 connected thereto. The control assembly 18 is operable in a conventional manner to drive the electric motor 21 at the desired speed as the motor 21 can be a variable speed type.

The drive motor 21 is operable to rotate a drive shaft 48 connected thereto which is conjointly operable to actuate the material lift means 72 and the apparatus drive means 78 in a manner to be explained.

The material lift means 72 includes a main lift plate member 27 having a main body portion 28 which is curved downwardly toward a forward section and formed with an outer blade portion with a plurality of adjacent, spaced teeth members 29.

The lift plate member 27 is formed at a rear section thereof with an arcuate curved portion 30 which is operable to receive the severed material or shingle members thereon in order to raise and move them laterally so as to not hinder movement and vision of the operator utilizing the material stripping apparatus 10 of this invention.

As noted in FIG. 4, the material lift means 72 further includes a bracket member 31 which is secured as by welding or the like to an undersurface of the lift plate member 27.

The material lift means 72 further includes an actuator assembly 81 with a pivotal rod member 32 which is pivotally connected and mounted with holes in the lift bracket 31. Opposite ends of the pivotal rod 32 are mounted within respective pillow blocks 33 which are connected by connector members 34 to a top surface of the bottom wall 13 as shown in FIG. 4. This controls movement of the lift plate member 27 in a forward and oscillating manner as the lower surface of the lift plate member 27 rests on the peripheral top edges 14 of the spaced, parallel sidewall members 12.

As noted in FIG. 6, the lift actuator means 74 includes a lift plate actuator assembly 83 having an elongated cam shaft 35 with opposite ends thereof mounted in bearing members 36 which, in turn, are mounted within respective flange mounts 37 that are secured to opposed, parallel sidewall members 12. The flange mounts 37 are secured by conventional bolts or fastener members 38 through openings so as to be rigidly secured in a fixed position to the respective sidewall members 12.

The lift actuator means 74 further includes a pair of spaced pillow block members 42, each having a disc-shaped cam member 40 therein which has the cam shaft 35 extended through an opening 85 for relative rotational movement. The pillow blocks 42 have inner peripheral surfaces 41 to receive the cam members 40 therewithin. Each pillow block 42 is secured as by fasteners 43 extended through openings 44 and to a bottom surface of the adjacent portion of the lift plate member 27. Then, rotation of the cam shaft 35 in the offset opening 85 of the cam member 40 causes the combination reciprocating and oscillating movement of the lift plate member 27 as will be explained.

More particularly, the disc shaped members 40 on rotation of the cam shaft 35 would then cause an oscillating movement of the pillow blocks 42 which, in turn, would impart this movement to the lift plate member 27.

As noted in a combination of FIGS. 6 and 7, the actuator drive means 76 includes a driven pulley 45 secured to the drive cam shaft 35; a belt member 46 trained over the driven pulley 45 at one thereof; and the belt member 46 is connected to a drive pulley 47 at the opposite end thereof.

As noted in FIG. 3, the belt member 46 is trained about the drive pulley 47 which is driven by a drive shaft 48 which is rotated as driven by the drive motor 21.

The actuator drive means 76 further includes a drive idler assembly 87 utilizing a drive idler pulley 49 which is mounted on a drive idler shaft member 50.

The drive idler shaft member 50 is mounted at opposite ends within respective bearing members 51 which are secured by fasteners 52 mounted through openings 53 to the respective, opposed, parallel upright sidewall members 12.

As noted in FIG. 7, the drive idler pulley 49 is operable to receive and transfer a driving force from the powered belt member 46 to rotate the drive idler shaft member 50.

As noted in FIG. 7, the apparatus drive means 78 includes a wheel drive pulley 54 which is mounted on the idler shaft member 50 for rotation therewith; a belt member 55 having one end trained about the wheel drive pulley 54; and an opposite end of the belt member 55 is trained about a wheel driven pulley 56 secured to a wheel assembly axle 25 having wheel members 24 connected to outer opposite ends thereof. Opposite ends of the wheel assembly axle 25 are rotatably mounted in bearing members in aligned holes in opposed portions of the side wall members 12.

It is noted that the apparatus drive means 78 includes the wheel drive shaft axle 25 having the wheel members 24 connected thereto and, through rotation of the belt member 55, drives the wheel driven pulley 56 on the wheel assembly axle or shaft 25 which would then drive the entire material stripping apparatus 10 in a forward direction.

The apparatus drive means 78 further includes a wheel idler pulley 57 as noted in FIGS. 5 and 7 being operable to be moved into and out of tension engagement with the belt member 55. This pressure engagement operates to increase pressure on the spaced respective wheel belt pulley 54 and the wheel driven pulley 56 which, in turn, would cause an increase or decrease in speed of rotation of the wheel assembly axle 25 to control speed of movement of the entire material stripping apparatus 10 through use of the apparatus control means 80 as will be noted.

As noted in FIG. 5, the apparatus control means 80 utilizes the aforementioned wheel idler pulley 57 which is rotatably mounted on a pin member 58 which, in turn, is secured to one end of a bell crank member 59.

The bell crank member 59 is of a generally L-shape having the pin member 58 connected to one end thereof; an opening 67 at the opposite end thereof having a flexible cable member 66 connected thereto; and a central portion thereof is provided with an opening 62 to receive a bolt or fastener member 61 therethrough to be attached to a bell crank bracket 60. The bell crank bracket 60 is rigidly secured as by a bolt member or the like to the upper surface of the bottom wall 13 of the main support frame assembly 11.

The fastener member 61 is extended through the opening 62 in the bell crank member 64; through a spacer washer member 59; and then through a hole 63 in an upper portion of the bell crank bracket 60. A lock nut fastener 65 is mounted on an opposite end of the fastener 61 to secure the above aligned elements together while permitting pivotal movement of the bell crank member 59 about the fastener member 61. This pivotal movement permits the bell crank member 59 to move the wheel idler pulley 57 into and out of engagement with the belt member 55 to increase driving movement of the entire material stripping apparatus 10 as will be explained.

The apparatus control assembly 80 further includes the flexible cable member 66 mounted within an opening 67 in the handle bar member 15 and having an opposite end connected to a control lever 23 which is pivotally connected as shown in FIG. 1 to a stationary drive control bracket 22. It is obvious that pivotal movement of the control level 23 in a conventional manner operates to move the flexible cable member 66 which, in turn, would pivot the bell crank member 59 to selectively increase and decrease movement of the wheel idler pulley 57 against the belt member 55 which would cease or cause movement of the drive wheels 24 mounted on the wheel assembly axle 25.

It is seen that movement of the lift plate member 27 is controlled through operation of the drive motor 21 and the belt member 46 which, through the disc shaped cam member 40, operates to move the pillow blocks 42 which are attached to the bottom surface of the lift plate member 27 in a reciprocating and oscillating manner. The movement of the entire material stripping apparatus 10 is controlled through the apparatus drive means 78 which is operable to drive axle 25 on rotational movement of the wheel driven pulley 56 attached thereto. The driven pulley 56 is driven through the belt member 55 and controlled through the movement of the bell crank member 59 by the flexible cable member 66. The driving force to rotate drive axle 25 and the wheel members 24 is transferred from the drive motor 21 and drive pulley 47; the belt member 46; the drive idler pulley 49 and the idler shaft member 50; and the wheel drive pulley 54 to the belt member 55 and the wheel driver pulley 56.

USE AND OPERATION OF THE INVENTION

In the use and operation of the material stripping apparatus 10 of this invention, it is noted that the entire structure is supported on the wheel members 24 for movement thereof. A forward bottom surface of the bottom wall 13 is adapted to act as a putty knife type blade so that the teeth 29 are positioned and placed under shingle members 94 as noted in FIG. 9. The teeth 29 agitate and lift the shingle members 94 to remove same along with the normal galvanized roofing nails that anchor the shingle members 94 to a support surface 96.

It is seen that the power means 70 of this invention is shown as being of variable speed electric drive motor 21 but it is obvious that a gasoline internal combustion type drive motor could be utilized with this invention.

In this invention, the drive motor 21 is energized and operated through the switch structure 18 having the actuator handle member 19 to provide power thru the cord member 17: In FIG. 1, the handle member 19 is shown in an inclined position that is the normal "off position". When the actuator handle member 19 is pushed forward, this operates to first energize the electric drive motor 21 and, on further forward movement thereof, operates to increase the speed of the variable speed drive motor 21 to control speed and operation of the entire material stripping apparatus 10.

The apparatus control means 80 is operable through the control lever 23 which is pivotally connected to the center and, at an outer end, connected to the cable member 66 which, in turn, at an opposite end is connected to the opening 67 in the bell crank member 59. It is noted that movement of the control lever 23 operates to pivotally move the pin member 58 and interconnected wheel idler pulley 57 in an arcuate manner as shown by the arrow 98 in FIG. 5 to the non-drive position.

Next, the cable member 66 is moveable as shown by an arrow 102 in FIG. 5 through operation of the control lever 23 to move the wheel idler pulley 57 in a downward motion into engagement with the belt member 55.

This transfers driving movement from the wheel drive pulley 54 to the wheel driven pulley 56 which, in turn, rotates the wheel axle member 25 and the wheel members 24. This would drive the entire material stripping apparatus 10 of this invention.

A new and novel feature of this invention is related to the combination reciprocating and oscillating movement of the lift plate member 27 with its front end teeth member 29 moveable under and upwardly of the shingle members 94.

As noted in FIG. 4, the movement of the lift plate member 27 is controlled in an oscillating and reciprocating manner due to the inclined downward nature of the peripheral top edges 14 on the parallel side wall members 12. The forward and backward movement in an arcuate direction is due to the pivotal rod 32 having opposite ends thereof mounted within the respective pillow blocks 33 and the lift means actuator bracket 31. It is obvious that opposite ends of the pivotal rods 32 are pivotal and rotatable in their respective mounting holes in order to achieve the reciprocating and oscillating movement.

The actual amount of movement of the lift plate member 27 is controlled through the rotational movement of the cam shaft 35 having opposite ends mounted within the bearings 36 and central portions thereof extended through the disc-shaped cam members 40. It is noted that the pillow blocks 42 are secured by the fastener members 43 to a bottom surface of the lift plate member 27 to achieve the new and novel movement of the lift plate member 27.

It is noted that the rotational speed of the cam shaft 35 is controlled through rotation of the drive pulley 47; the belt member 46; and the driven pulley 45 which is secured to subject cam shaft 35.

It is noted that the material stripping apparatus of this invention provides a lightweight portable, new and novel structure having an arcuate lift plate member to be placed beneath the shingle members to provide a lifting and oscillating movement thereunder which would automatically move the loosened and severed shingle members upwardly and rearwardly on the arcuate rear portion of the lift plate member. The shingle members would be moved upwardly and subsequently laterally due to the force of gravity so as to not obscure the vision of the operator using same.

It is noted that the material stripping apparatus of this invention is portable in nature; sturdy in construction; easily operable similar to a lawn mower; safe in operation; and substantially maintenance free.

While the invention has been described in conjunction with preferred specific embodiments thereof, it would be understood that this description is intended to illustrate and not to limit the scope of the invention, which is defined by the following claims.

I claim:

1. A material stripping apparatus adapted to remove a material such as shingle members from a support surface such as a roof, comprising:

(a) a main support frame assembly having an apparatus drive assembly mounted thereon so as to be moveable similar to a lawn mower structure;

(b) a material lift means mounted on said main support frame assembly having a lift plate member moveable in a forward and upward oscillating motion relative to said main support frame assembly;

(c) a lift actuator means connected between said main support frame assembly and said material lift means operable to control movement of said lift plate member in a reciprocating and oscillating manner so as to get underneath the shingle members and lift and move same upwardly and laterally;

(d) said main support frame assembly having a pair of spaced, parallel sidewall members with upper aligned support surfaces thereon;

(e) said lift plate member engagable with said support surfaces so as to move downwardly and upwardly thereon in a reciprocating and oscillating motion;

(f) a lift actuator means having a cam member mounted within a pillow block and a cam shaft extended through an offset opening in said cam member;

(g) said pillow block is secured to said lift plate member; and (h) said cam shaft having opposite ends rotatably mounted in bearing members which, in turn, are connected to respective ones of said sidewall members;

whereby said cam member is rotatable within said pillow block being connected to said lift plate member to provide for vertical and horizontal movement of said lift plate member.

2. A material stripping apparatus operable to get under one edge of a material secured to a support surface and to provide a blade member to move the material in an oscillating manner about both vertical and horizontal axes to remove same from the support surface, comprising:

(a) a main support frame means having an apparatus drive means mounted thereon, said main support frame means having a frame member mounted on said apparatus drive means for movement of said main support frame means;

(b) a material lift means mounted on said main support frame means and having a lift plate member moveable in a forward, rearward, up and down motion to lift the material from the support surface;

(c) a lift actuator means connected to said material lift means so as to move said lift plate member in the oscillating manner as set forth above (d) an actuator drive means having a cam shaft mounted within a disc cam member connected to a pillow block which is secured to an undersurface of said lift plate member;

(e) said lift plate member having a main support plate member with a plurality of forwardly protruding teeth members;

(f) said teeth members insertable under the material so as to contact the material and move same upwardly and laterally;

(g) a power means mounted on said main support frame means and operably connected to said apparatus drive means;

(h) an apparatus control means having a means thereon to control operation of said power means which drives said apparatus drive means in order to drive the entire said material stripping apparatus at desired speed and horizontal direction; and (i) said apparatus control means having a control means connected to said actuator drive means to control speed and operation of said lift plate member during the material lifting and removing steps of this invention.

3. A material stripping apparatus operable to get under one edge of a material secured to a support surface and to provide a blade member to move the material in an oscillating manner about both vertical and horizontal axes to remove same from the support surface, comprising:

(a) a main support frame means having a pair of spaced, parallel sidewall members with upper aligned surfaces thereon;

(b) a power means and a material lift means mounted on said main support frame means;

(c) a lift actuator means operably connected to the material lift means;

(d) said material lift means having a lift plate member projecting forwardly from said main support frame means supported on said support surfaces and operable to move in a forward, rearward, and up and down motion to lift the material from the support surface; and (e) said material lift means includes a bracket member secured to said lift plate member, a pillow block secured to said main support frame, and a rod member having opposite ends thereof pivotally connected to said pillow block and said bracket member to maintain contact said lift plate member with said support surfaces of said sidewall members.

4. A material stripping apparatus as described in claim 3, wherein:

(a) said lift actuator means includes a lift plate actuator assembly having a cam shaft rotatably mounted in bearing members secured to opposite ones of said sidewall members;

(b) said lift actuator means further includes pillow members each having a cam member with an opening therein, said cam members having said cam shaft connected thereto and mounted said openings; and (c) said pillow members secured to said lift plate member;

whereby rotation of said cam shaft and said cam members causes said lift plate member to reciprocate and oscillate to remove the material mounted on the support surface.

5. A material stripping apparatus as described in claim 4, includes:

(a) said lift plate member having a rearwardly extended arcuate curved portion to receive the severed material thereon and to continuously move the subject severed material reawardly to said arcuate curved portion and laterally of said main support frame means.

6. A material stripping apparatus as described in claim 3, including:

(a) said actuator drive means having a cam shaft mounted within a disc cam member connected to a pillow block which is secured to an undersurface of said lift plate member whereby said cam shaft is movable in a circular path so as to move said pillow block vertically and horizontal so as to move said lift plate member to achieve an oscillating movement thereof and the rotation of said cam shaft and the limitation of said rod member engagable with said lift plate member operates to achieve the reciprocating and oscillating motion of said left plate member.

* * * * *